US011340005B2

(12) United States Patent
Nilsen et al.

(10) Patent No.: US 11,340,005 B2
(45) Date of Patent: May 24, 2022

(54) HYBRID METHOD AND SYSTEM FOR TRANSPORTING AND/OR STORING TEMPERATURE-SENSITIVE MATERIALS

(71) Applicant: Cold Chain Technologies, LLC, Franklin, MA (US)

(72) Inventors: James Nilsen, Mays Landing, NJ (US); Amanda L. Longley, Hudson, MA (US)

(73) Assignee: COLD CHAIN TECHNOLOGIES, LLC, Franklin, MA (US)

( * ) Notice: Subject to any disclaimer, the term of this patent is extended or adjusted under 35 U.S.C. 154(b) by 0 days.

(21) Appl. No.: 15/659,147

(22) Filed: Jul. 25, 2017

(65) Prior Publication Data

US 2018/0100682 A1 Apr. 12, 2018

Related U.S. Application Data

(60) Provisional application No. 62/366,384, filed on Jul. 25, 2016.

(51) Int. Cl.
*F25D 11/00* (2006.01)
*F25D 16/00* (2006.01)
(Continued)

(52) U.S. Cl.
CPC ..... *F25D 11/006* (2013.01); *F25D 16/00* (2013.01); *F25D 29/003* (2013.01); *F25B 21/02* (2013.01);
(Continued)

(58) Field of Classification Search
CPC ..... F25D 3/08; F25D 2303/08222; F25D 2303/082; F25D 2303/0821;
(Continued)

(56) References Cited

U.S. PATENT DOCUMENTS 2,915,884 A 12/1959 Haushalter et al.
4,308,724 A * 1/1982 La Ginestra ..... 340/585
(Continued)

FOREIGN PATENT DOCUMENTS

DE 4142842 A1 4/1993
WO 02086980 A1 10/2002
(Continued)

OTHER PUBLICATIONS

Kjallander et al., "A Five-Step Approach to Optimizing Cost and Performance in the Temperature-Controlled Transport of High-Value Pharmaceutical Shipments," World Courier—AmerisourceBergen (Sep. 28, 2014).
(Continued)

*Primary Examiner* — Lionel Nouketcha
(74) *Attorney, Agent, or Firm* — Kriegsman & Kriegsman

(57) ABSTRACT

A method and system for transporting and/or storing temperature-sensitive materials. In one embodiment, the system may be a hybrid system that includes an active temperature-control system and a passive temperature-control system. The active temperature-control system may be, for example, a portable refrigerator that includes an internal chamber for maintaining contents within a desired temperature range. The passive temperature-control system, which includes at least one phase-change material (PCM) member and space for receiving one or more temperature-sensitive materials, may be removably positioned entirely within the internal chamber of the active temperature-control system. When temperature-sensitive materials are loaded into the passive temperature-control system and the passive temperature-control system is loaded into the active temperature-control system, the active temperature-control system keeps the temperature-sensitive materials within a desired temperature range and charges the PCM members for when the passive
(Continued)

temperature-control system is thereafter removed from the active temperature-control system.

21 Claims, 12 Drawing Sheets

(51) Int. Cl.
*F25D 3/08* (2006.01)
*F25D 29/00* (2006.01)
*F25B 21/02* (2006.01)

(52) U.S. Cl.
CPC ..... *F25D 3/08* (2013.01); *F25D 11/003* (2013.01); *F25D 2331/801* (2013.01); *F25D 2331/804* (2013.01); *F25D 2400/12* (2013.01); *F25D 2400/36* (2013.01)

(58) Field of Classification Search
CPC ..... F25D 2303/0832; F25D 2400/36; F25D 16/00; F25D 11/006; F25D 2400/12; B65B 63/08; B65D 21/0234; B65D 81/18; F25B 21/02; A45C 11/20
See application file for complete search history.

(56) References Cited

U.S. PATENT DOCUMENTS 4,367,633 A 1/1983 Strathman
4,543,471 A 9/1985 Anderson
4,637,222 A 1/1987 Fujiwara et al.
4,759,190 A 7/1988 Trachtenberg et al.
5,187,947 A 2/1993 Breunig et al.
5,319,937 A 6/1994 Fritsch et al.
5,379,596 A 1/1995 Grayson
5,483,799 A 1/1996 Dalto
5,522,216 A 6/1996 Park et al.
5,603,220 A 2/1997 Seaman
5,722,254 A 3/1998 Roth et al.
5,860,281 A 1/1999 Coffee et al.
5,943,876 A 8/1999 Meyer et al.
5,950,450 A 9/1999 Meyer et al.
6,021,642 A 2/2000 Guinn
6,026,647 A 2/2000 Coffee et al.
6,192,703 B1 2/2001 Salyer et al.
6,244,067 B1 6/2001 Roth et al.
6,244,458 B1 6/2001 Frysinger et al.
6,293,124 B1 9/2001 Roth et al.
6,293,962 B1 9/2001 Bishay
6,301,901 B1 10/2001 Coffee et al.
6,308,518 B1 10/2001 Hunter
6,354,104 B1 3/2002 Feagin
6,427,475 B1 8/2002 DeFelice et al.
6,476,509 B1 * 11/2002 Chen et al.
6,482,332 B1 11/2002 Malach
6,519,948 B2 * 2/2003 Zorn ..... A45C 5/14 62/3.6
6,729,144 B1 5/2004 Kupferman
6,751,963 B2 6/2004 Navedo et al.
6,799,434 B1 10/2004 Hobbs, Jr.
6,822,198 B2 11/2004 Rix
6,860,115 B2 3/2005 Norelius et al.
6,868,982 B2 3/2005 Gordon
6,976,371 B2 12/2005 Gleason et al.
7,096,676 B2 8/2006 Zelissen et al.
7,240,513 B1 7/2007 Conforti
7,735,334 B2 6/2010 Johnson
7,908,870 B2 3/2011 Williams et al.
8,011,171 B2 9/2011 Repkin et al.
8,061,149 B1 11/2011 Gowans
8,161,756 B2 * 4/2012 Kutta ..... F25D 25/04 221/150 R
8,225,616 B2 7/2012 Wilkinson et al.
8,250,881 B1 8/2012 Reihl
8,250,882 B2 8/2012 Mustafa et al.
8,307,664 B2 * 11/2012 Whillock, Sr. ..... F25B 21/02 62/3.63
8,353,167 B2 1/2013 McGann
8,468,836 B2 6/2013 Tuszkiewicz et al.
8,490,413 B2 7/2013 Blackway et al.
8,539,790 B1 9/2013 Budd
8,567,211 B2 10/2013 Al-Rasheed
8,607,581 B2 12/2013 Williams et al.
8,708,197 B1 4/2014 Brewer
8,713,953 B1 5/2014 Tucker
8,844,756 B2 * 9/2014 Beyburg ..... A47B 71/00 220/592.01
8,887,515 B2 11/2014 Patstone
8,978,392 B2 3/2015 Blackway et al.
9,045,278 B2 * 6/2015 Mustafa ..... B65D 81/3862
9,151,531 B2 10/2015 Wengreen et al.
9,180,998 B2 11/2015 Banks et al.
9,182,155 B2 11/2015 Crumlin et al.
9,556,373 B2 1/2017 Formato et al.
9,598,622 B2 3/2017 Formato et al.
9,689,602 B2 6/2017 Emond et al.
9,707,156 B2 7/2017 Wengreen et al.
9,814,651 B2 11/2017 Wengreen et al.
9,877,894 B2 1/2018 Wengreen et al.
9,913,777 B2 3/2018 Wengreen et al.
9,956,140 B2 5/2018 Wengreen et al.
10,077,389 B2 9/2018 Formato et al.
10,309,709 B2 6/2019 Emond et al.
10,337,784 B2 7/2019 Mills et al.
10,661,969 B2 5/2020 Pranadi et al.
10,829,675 B2 11/2020 Formato et al.
2002/0084206 A1 * 7/2002 Protopapas ..... A45C 11/20 206/542
2004/0226309 A1 11/2004 Broussard
2006/0011686 A1 * 1/2006 Latham ..... B60R 7/04 224/579
2006/0276768 A1 12/2006 Miller et al.
2007/0025647 A1 * 2/2007 Hamlin ..... B25H 3/00 383/14
2007/0032774 A1 2/2007 Glade et al.
2007/0119187 A1 5/2007 Kitchens et al.
2008/0145919 A1 6/2008 Franklin et al.
2008/0164265 A1 * 7/2008 Conforti ..... B65D 81/3823 220/592.2
2008/0245096 A1 * 10/2008 Hanson ..... A45C 11/20 62/457.2
2009/0158770 A1 6/2009 Cohrs et al.
2011/0048062 A1 3/2011 Gielda et al.
2011/0073609 A1 * 3/2011 Lesquir ..... B65D 25/32 220/763
2011/0185764 A1 8/2011 Kelly
2011/0214449 A1 * 9/2011 Deng ..... F25B 17/00 62/457.9
2012/0248101 A1 * 10/2012 Tumber ..... F25D 3/08 220/1.5
2013/0310802 A1 11/2013 Weinmann
2014/0130526 A1 5/2014 Kerkmans
2014/0138392 A1 * 5/2014 McCormick ..... B65D 25/10 220/592.2
2014/0157794 A1 6/2014 McGann
2014/0338390 A1 11/2014 Pinto et al.
2014/0343493 A1 11/2014 Wengreen
2015/0153087 A1 * 6/2015 Yamashita ..... F25D 3/00 62/457.2
2015/0191291 A1 7/2015 Wood et al.
2015/0217656 A1 * 8/2015 Loftus ..... H02J 2207/20 320/136
2015/0239639 A1 8/2015 Wenner et al.
2015/0276297 A1 10/2015 Moore et al.
2015/0360842 A1 * 12/2015 Bessho ..... F25D 3/04 312/236
2016/0054036 A1 * 2/2016 Ilercil ..... F25B 21/04 62/3.62
2016/0073751 A1 * 3/2016 Charlebois ..... A45C 11/20 206/545
2016/0075498 A1 * 3/2016 Mayer ..... B65D 81/3825 220/592.26

(56) References Cited

U.S. PATENT DOCUMENTS

| | | | | |
|---|---|---|---|---|
| 2016/0135447 | A1* | 5/2016 | Visinoni | A01N 1/0257 435/366 |
| 2016/0262979 | A1 | 9/2016 | Wengreen et al. | |
| 2017/0096283 | A1 | 4/2017 | Longley et al. | |
| 2017/0131015 | A1 | 5/2017 | Farrar | |
| 2018/0036202 | A1 | 2/2018 | Wengreen et al. | |
| 2018/0093816 | A1 | 4/2018 | Longley et al. | |
| 2018/0328644 | A1 | 11/2018 | Rizzo et al. | |
| 2019/0210790 | A1 | 7/2019 | Rizzo et al. | |
| 2019/0285328 | A1 | 9/2019 | Emond et al. | |

FOREIGN PATENT DOCUMENTS

| | | | |
|---|---|---|---|
| WO | 03073030 | A1 | 9/2003 |
| WO | 2008074011 | A2 | 6/2008 |
| WO | 2014080197 | A1 | 5/2014 |
| WO | 2015081305 | A2 | 6/2015 |
| WO | 2015084700 | A1 | 6/2015 |
| WO | 2018213348 | A2 | 11/2018 |

OTHER PUBLICATIONS

Sales literature for Dometic S.ar.l entitled "Medical Systems—Technology for Life," Hosingen, Luxembourg (2011).

Alvenby et al., "Medical Cooler: Development of a modern medical cooler for personal use," Master of Science Thesis in Industrial Design Engineering, Chalmers University of Technology, Gothenburg, Sweden (2013).

Abstract of Conway et al., "Improving cold chain technologies through the use of phase change material," University of Maryland Libraries—Digital Repository at the University of Maryland (2012).

Sales literature for Dison 2-8C thermoelectric cooler box for insulin, vaccine, interferon, medical refrigerators, Zhengzhou Dison Electric Co., Ltd. (2013).

Sales literature for Labfreeze 1.5L Portable Pharmaceutical refrigerator, Insulin fridges, car fridge, Labfreeze Instruments (2016).

Sales literature for Lifoam Envirocooler Activault, Lifoam Industries, LLC (2017).

Marques et al., "The use of phase change materials in domestic refrigeration applications," Proc. Inst. R., 2013-14, 2-12.

Sales literature for Pharma Cooling b.v. (2015).

Sales literature for Dometic Cooling Boxes Coolfreeze, Dometic Waeco International GmbH, Emsdetten, Germany (2017).

BusinessWire article entitled "Cold Chain Technologies Responds to Envirotainer's Resized RKN t2 Pallet Shipper," (2009); https://www.businesswire.com/news/home/20090306005069/en/Cold-Chain-Technologies-Responds-Envirotainers-Resized-RKN.

Sales literature for Envirotainer RKN t2 container, Envirotainer AB (2018); https://www.envirotainer.com/en/active-containers/our-container-products/envirotainer-rkn-t2/.

Sales literature for KoolTemp insulated pallet container—ZX4500, Cold Chain Technologies, Inc. (2009).

* cited by examiner

HYBRID METHOD AND SYSTEM FOR TRANSPORTING AND/OR STORING TEMPERATURE-SENSITIVE MATERIALS

CROSS-REFERENCE TO RELATED APPLICATIONS

The present application claims the benefit under 35 U.S.C. 119(e) of U.S. Provisional Patent Application No. 62/366,384, inventors James Nilsen et al., filed Jul. 25, 2016, the disclosure of which is incorporated herein by reference.

BACKGROUND OF THE INVENTION

The present invention relates generally to methods and systems for transporting and/or storing temperature-sensitive materials and relates more particularly to a novel such method and system.

There are many types of scenarios in which a temperature-sensitive material must be transported from one location to another location under controlled temperature conditions. For example, it is often necessary for pharmaceutical salespeople to make sales-related visits to one or more physicians and to transport temperature-sensitive pharmaceutical samples to the physicians as a part of such visits. To-date, there are two principal methods by which such transportation is made. According to one method, the samples are stored in an insulated carry bag or roller bag, which the salesperson transports from visit to visit. Typically, one or more preconditioned phase-change material (PCM) members, such as refrigerated or frozen cold packs, are positioned within the carry bag or roller bag to keep the pharmaceutical samples within a desired temperature range. An arrangement of this type, which relies on preconditioned PCM members to keep an object within a desired temperature range, is typically known in the industry as a passive system. One problem that the present inventors have identified with a passive system of this type is that the salesperson must properly condition the one or more PCM members, which are typically in the form of cold packs, by freezing or refrigerating the cold packs at a proper temperature for a particular period of time prior to placement of the cold packs in the insulated bag. As can be appreciated, a failure to properly precondition the cold packs may adversely affect the performance of the system. Another problem that the present inventors have identified with this type of system is that, over the course of a day, the insulated bag typically is opened and closed many times as samples are removed from the bag. However, each time that the bag is opened, the contents of the bag are exposed to the surrounding air, typically causing a warming of the cold packs in the bag. As can be appreciated, such a warming of the cold packs decreases the duration at which the system can maintain the samples within a desired temperature range. Moreover, there is typically no way for the salesperson to mitigate the effects of such warming since the salesperson typically has no way to recharge, i.e., recondition, the cold packs while making visits to physicians.

According to another method, an active temperature-control system is employed by the salesperson. Typically, such an active temperature-control system is in the form of a portable refrigerator that can be plugged into and powered by the salesperson's automobile and that can be used to store the samples at a desired temperature. Typically, the pharmaceutical samples are stored bare (i.e., not within another container) in the portable refrigerator. When the salesperson wishes to deliver a sample to a physician, either the sample is removed from the refrigerator and is brought into the physician's office completely unprotected to the thermal effects of the environment, or the sample is transferred from the portable refrigerator to a secondary insulated container that had been stored independently of the portable refrigerator and that may be equipped with one or more PCM members. One problem that the present inventors have identified with this method is that, once the sample has been removed from the refrigerator and is placed, for example, in the secondary insulated container, the same types of problems as described above in connection with the first method apply to the transport of the sample in the secondary container. Another problem that the present inventors have identified with this method is that, while the refrigerator is open to permit the removal of one sample, the other samples that remain in the refrigerator are exposed to the warming effects of outside air.

Documents of interest may include the following, all of which are incorporated herein by reference: U.S. Pat. No. 8,061,149 B1, inventors Gowans et al., issued Nov. 22, 2011; U.S. Pat. No. 7,240,513 B1, inventor Conforti, issued Jul. 10, 2007; U.S. Pat. No. 6,799,434 B1, inventor Hobbs, Jr., issued Oct. 5, 2004; U.S. Pat. No. 6,751,963 B2, inventors Navedo et al., issued Jun. 22, 2004; U.S. Pat. No. 6,519,948 B2, inventor Zorn, issued Feb. 18, 2003; U.S. Pat. No. 6,427,475 B1, inventors DeFelice et al., issued Aug. 6, 2002; U.S. Pat. No. 6,354,104 B1, inventor Feagin, issued Mar. 12, 2002; U.S. Pat. No. 6,301,901 B1, inventors Coffee et al., issued Oct. 16, 2001; U.S. Pat. No. 6,192,703 B1, inventors Salyer et al., issued Feb. 27, 2001; U.S. Pat. No. 6,026,647, inventors Coffee et al., issued Feb. 22, 2000; U.S. Pat. No. 5,950,450, inventors Meyer et al., issued Sep. 14, 1999; U.S. Pat. No. 5,943,876, inventors Meyer et al., issued Aug. 31, 1999; U.S. Pat. No. 5,860,281, inventors Coffee et al., issued Jan. 19, 1999; U.S. Pat. No. 5,319,937, inventors Fritsch et al., issued Jun. 14, 1994; U.S. Pat. No. 4,759,190, inventors Trachtenberg et al., issued Jul. 26, 1988; U.S. Pat. No. 4,637,222, inventors Fujiwara et al., issued Jan. 20, 1987; U.S. Pat. No. 4,543,471, inventor Anderson, issued Sep. 24, 1985; U.S. Pat. No. 4,367,633, inventor Strathman, issued Jan. 11, 1983; and PCT International Publication No. WO 2015/081305 A2, published Jun. 4, 2015.

SUMMARY OF THE INVENTION

It is an object of the present invention to provide a novel system for transporting and/or storing temperature-sensitive materials.

Therefore, according to one aspect of the invention, there is provided a hybrid system for transporting and/or storing temperature-sensitive materials, the hybrid system comprising: (a) an active temperature-control system, the active temperature-control system being configured to be powered at least by a portable power source and comprising an internal chamber for maintaining contents within a desired temperature range; and (b) a passive temperature-control system, the passive temperature-control system being removably positioned entirely within the internal chamber of the active temperature-control system and comprising at least one phase-change material (PCM) member and space for receiving one or more temperature-sensitive materials.

According to a more detailed feature of the invention, the active temperature-control system may comprise at least one of a portable refrigerator, a portable freezer, and a portable incubator.

According to a more detailed feature of the invention, the active temperature-control system may comprise a portable refrigerator.

According to a more detailed feature of the invention, the portable refrigerator may be configured to be powered by a vehicle comprising an electrical system.

According to a more detailed feature of the invention, the portable refrigerator may have a weight of approximately 10 kg to 35 kg and may have outer dimensions not exceeding 1 cubic meter.

According to a more detailed feature of the invention, the portable refrigerator may have outer dimensions ranging from approximately 350 mm×425 mm×625 mm to approximately 950 mm×475 mm×530 mm.

According to a more detailed feature of the invention, the portable refrigerator may comprise a body and a cover, and the body and the cover may jointly define the internal chamber.

According to a more detailed feature of the invention, the portable refrigerator may comprise a control panel, and the control panel may include a display for indicating if the internal chamber is within a desired temperature range.

According to a more detailed feature of the invention, the passive temperature-control system may comprise at least one of an insulated carry bag, an insulated roller bag, and an insulated box.

According to a more detailed feature of the invention, the passive temperature-control system may comprise an insulated carry bag.

According to a more detailed feature of the invention, the insulated carry bag may comprise a cavity divided into a payload receiving space and at least one PCM member receiving space, and the at least one PCM member may be disposed in the at least one PCM member receiving space.

According to a more detailed feature of the invention, the insulated carry bag may further comprise a handle.

According to a more detailed feature of the invention, the insulated carry bag may further comprise at least one standoff.

According to a more detailed feature of the invention, the insulated carry bag may have outer dimensions of 11 inches×11 inches×11 inches.

According to a more detailed feature of the invention, the passive temperature-control system may comprise an insulated corrugate box.

According to a more detailed feature of the invention, the at least one phase-change material (PCM) member and the space for receiving one or more temperature-sensitive materials may be disposed within the insulated corrugate box.

According to a more detailed feature of the invention, the insulated corrugate box may have interior dimensions of approximately 11.75 inches×11.75 inches×11.75 inches.

According to a more detailed feature of the invention, the PCM member may have a phase-change temperature that is within the desired temperature range of the active temperature-control member.

It is also an object of the present invention to provide a novel method for transporting and/or storing temperature-sensitive materials.

Therefore, according to one aspect of the invention, there is provided a method for transporting and/or storing temperature-sensitive materials, the method comprising (a) providing a hybrid system for transporting and/or storing temperature-sensitive materials, the hybrid system comprising (i) an active temperature-control system, the active temperature-control system being configured to be powered at least by a portable power source and comprising an internal chamber for maintaining contents within a desired temperature range; and (ii) a passive temperature-control system, the passive temperature-control system being configured to be removably positioned entirely within the internal chamber of the active temperature-control system and comprising at least one phase-change material (PCM) member and space for receiving one or more temperature-sensitive materials; (b) powering the active temperature-control system using a portable power source; (c) loading a plurality of temperature-sensitive material specimens into the passive temperature-control system; (d) loading the passive temperature-control system into the internal chamber of the active temperature-control system; (e) then, transporting the hybrid system to a first location; (f) then, removing the passive temperature-control system from the active temperature-control system; (g) then, transporting the passive temperature-control system to a second location; (h) then, removing some, but not all, of the temperature-sensitive material specimens from the passive temperature-control system; and (i) then, reloading the passive temperature-control system and the remaining temperature-sensitive material specimens into the active temperature-control system.

According to a more detailed feature of the invention, the method may further comprise the steps of (a) after the reloading step, transporting the hybrid system to a third location; (b) then, removing the passive temperature-control system from the active temperature-control system; (c) then, transporting the passive temperature-control system to a fourth location; and (d) then, removing at least some of the remaining temperature-sensitive material specimens from the passive temperature-control system.

For purposes of the present specification and claims, various relational terms like "top," "bottom," "proximal," "distal," "upper," "lower," "front," and "rear" may be used to describe the present invention when said invention is positioned in or viewed from a given orientation. It is to be understood that, by altering the orientation of the invention, certain relational terms may need to be adjusted accordingly.

Additional objects, as well as aspects, features and advantages, of the present invention will be set forth in part in the description which follows, and in part will be obvious from the description or may be learned by practice of the invention. In the description, reference is made to the accompanying drawings which form a part thereof and in which is shown by way of illustration various embodiments for practicing the invention. The embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense.

BRIEF DESCRIPTION OF THE DRAWINGS

The accompanying drawings, which are hereby incorporated into and constitute a part of this specification, illustrate various embodiments of the invention and, together with the description, serve to explain the principles of the invention. These drawings are not necessarily drawn to scale, and certain components may have undersized and/or oversized dimensions for purposes of explication. In the drawings wherein like reference numerals represent like parts.

DETAILED DESCRIPTION OF THE INVENTION

Figure 1:
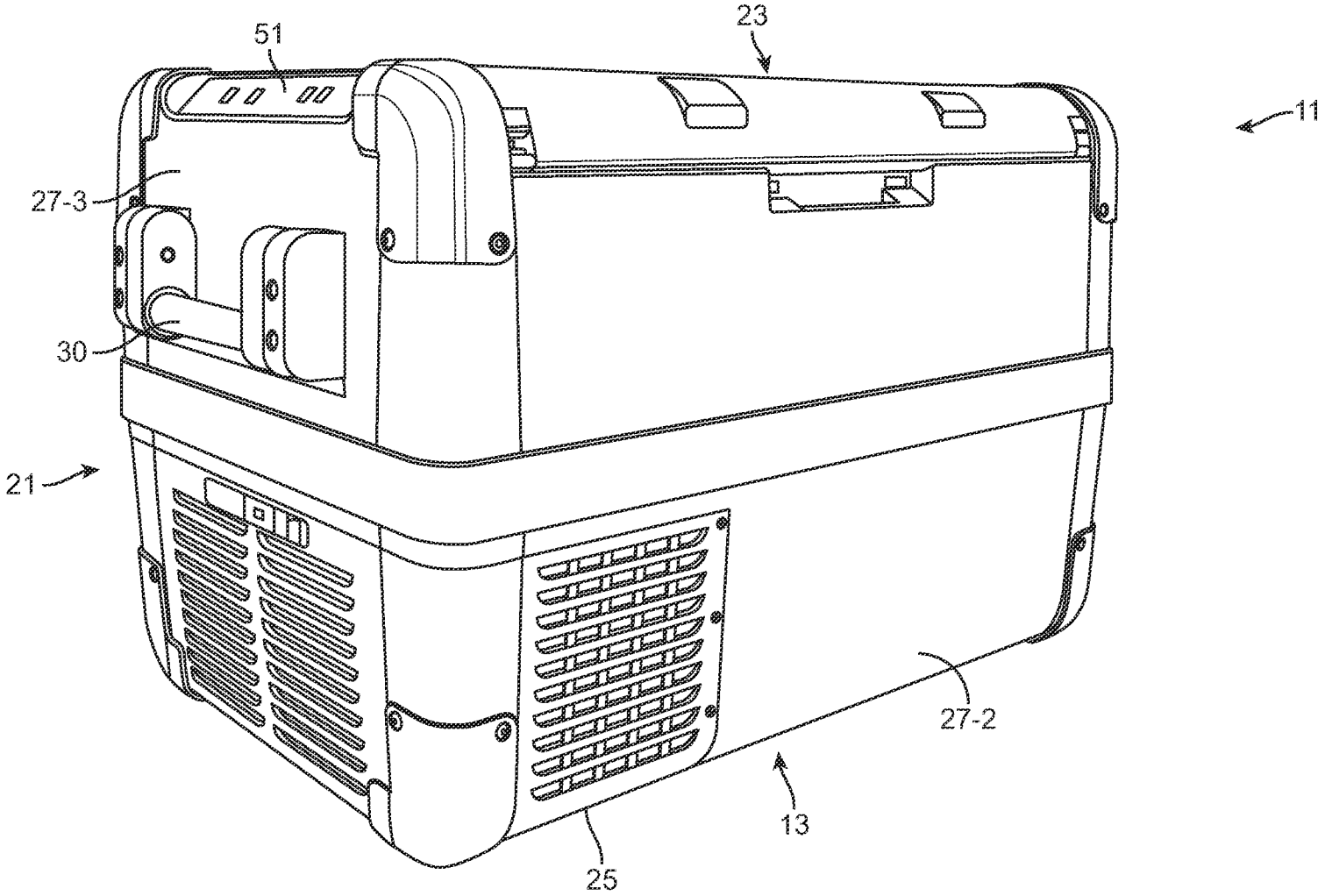
FIG. 1 is a perspective view of one embodiment of a hybrid system for transporting and/or storing temperature-sensitive materials, the hybrid system being constructed according to the present invention and being shown with the cover of the active temperature-control system in a closed state.

The present invention is directed at a hybrid system for transporting and/or storing temperature-sensitive materials. The hybrid system may include two subsystems that are designed to function together as part of a complete system. The first subsystem may be an active temperature-control system, and the second subsystem may be a passive temperature-control system.

The active temperature-control system may be any sort of portable device that may be powered by a portable power source and that is used to maintain one or more objects at a desired temperature or within a desired temperature range. Examples of an active temperature-control system may include, but are not limited to, a portable refrigerator, a portable freezer, a portable incubator, or the like. Preferably, the active temperature-control system is a vapor compression-based refrigeration system and more preferably is a vapor compression-based portable refrigerator of the type that is capable of being powered by the electrical system of an automobile or other vehicle. Notwithstanding the above, the active temperature-control system may alternatively be a thermoelectric or Peltier-based refrigeration system and/or may be operated using alternative power sources (e.g., solar power, AC power, etc.).

The passive temperature-control system may comprise an insulated container preferably equipped with one or more PCM members. The insulated container, which may be, but is not limited to, an insulated carry bag, an insulated roller bag, or an insulated corrugate box, is preferably designed so that the entire passive temperature-control system fits entirely within the active temperature-control system. For example, the active temperature-control system may have an interior compartment, and the insulated container, together with the one or more PCM members, may fit entirely within the interior compartment of the active temperature-control system. The insulated container may define a volume that may be used to hold all of the samples one wishes to transport and/or store. Standoffs may be provided on the exterior of the insulated container to promote airflow around the exterior of the insulated container when the insulated container is positioned within the active temperature-control system.

When the passive temperature-control system is positioned within the active temperature-control system, the active temperature-control system preferably maintains, at a desired temperature or temperature range, all of the samples positioned within the insulated container of the passive temperature-control system. In addition, the active temperature-control system also preferably keeps all of the PCM members of the passive temperature-control system properly conditioned at the same desired temperature or temperature range. In this manner, when the passive temperature-control system is removed from the active temperature-control system, the one or more PCM members preferably maintain the samples within the insulated container at the desired temperature or temperature range. After a delivery of a sample is made, the passive temperature-control system is preferably returned to the active temperature-control system so that the remaining samples in the insulated container are again subjected to the thermal control of the active temperature-control system and so that the PCM members of the passive temperature-control system may be recharged.

Figure 2:
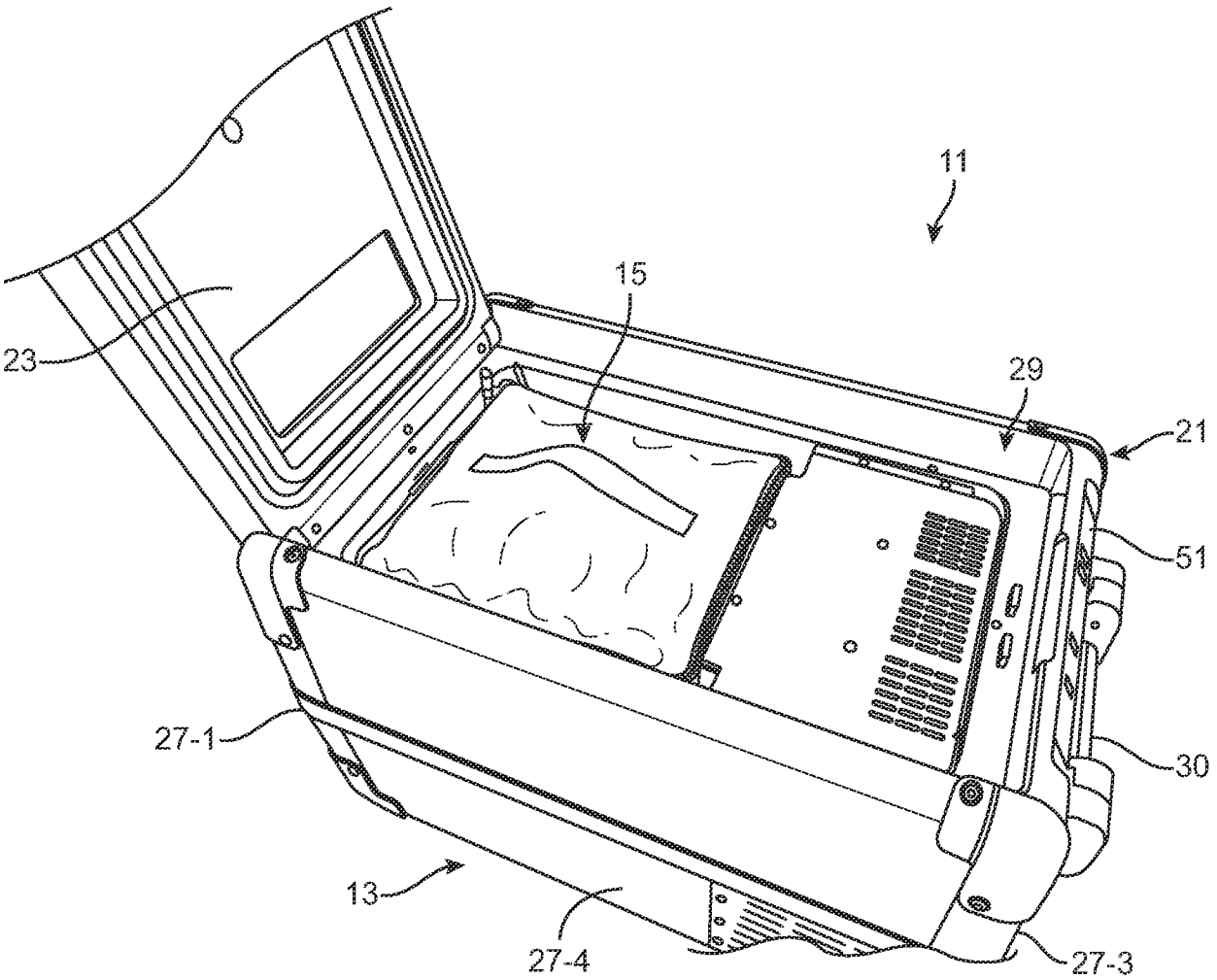
FIG. 2 is a perspective view of the hybrid system shown in FIG. 1, with the cover of the active temperature-control system being shown in an open state to reveal the passive temperature-control system disposed within the active temperature-control system.

Referring now to FIGS. 1 and 2, there are shown different views of one embodiment of a hybrid system for transporting and/or storing temperature-sensitive materials, the hybrid system being constructed according to the present invention and being represented generally by reference numeral 11.

Hybrid system 11 may comprise an active temperature-control system 13 and a passive temperature-control system 15.

Figure 3A:
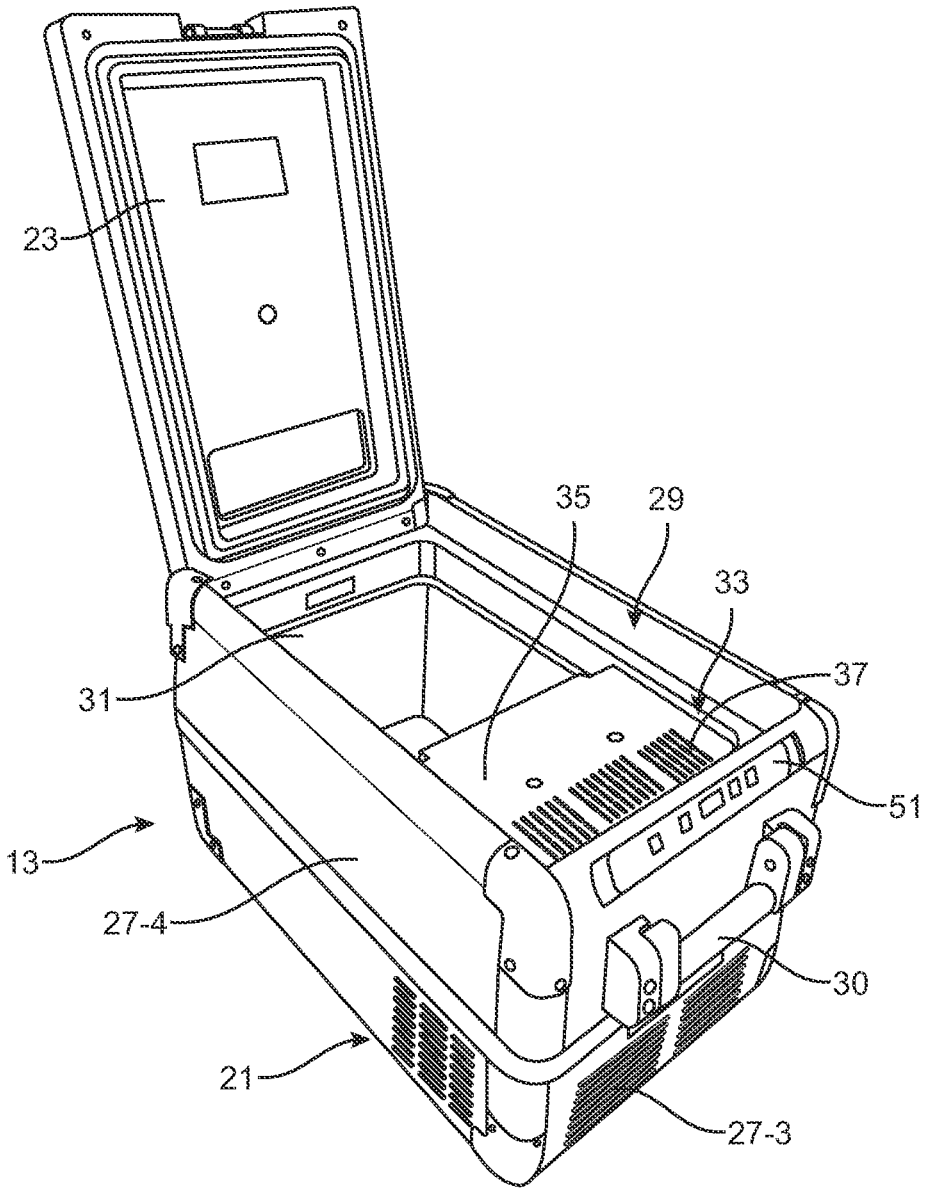
FIGS. 3(*a*) and 3(*b*) are front perspective and fragmentary rear perspective views, respectively, of the active temperature-control system shown in FIG. 1, the active temperature-control system being shown with its cover in an open state.
Figure 3B:
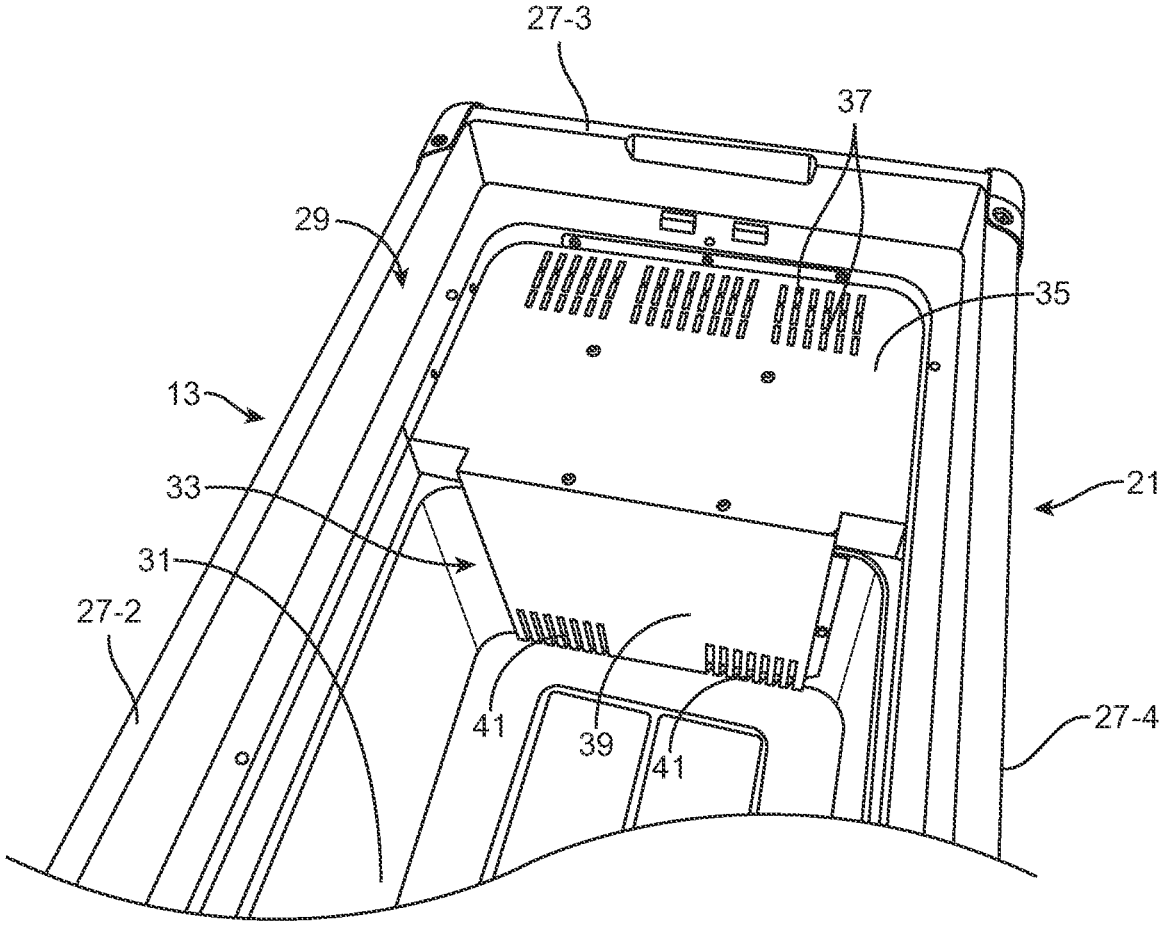

Active temperature-control system 13, which is also shown separately in FIGS. 3(*a*) and 3(*b*), may be a portable refrigerator and preferably is a vapor compression-based portable refrigerator of the type that is capable of being powered by the electrical system of an automobile or other vehicle. If desired, active temperature-control system 13 may be capable of being powered by either alternating current (e.g., 120V AC current) or direct current (e.g., 12V DC current). Preferably, active temperature-control system 13 is configured for easy portability. As an example, but not wishing to be limited thereto, active temperature-control system 13 may have a weight of approximately 10 kg to 35 kg and may have outer dimensions of less than 1 cubic meter, preferably ranging from approximately 350 mm×425 mm×625 mm to approximately 950 mm×475 mm×530 mm. Commercially available portable refrigerators that may be suitable for use as active temperature-control system 13 may include, but are not limited to, DOMETIC CFX cooling boxes (Dometic Waeco International GmbH, Emsdetten, Germany).

Active temperature-control system 13 may include a body 21 and a cover 23. Body 21, in turn, may include a bottom 25 and four sides 27-1 through 27-4. Each of bottom 25 and four sides 27-1 through 27-4 may be generally rectangular in shape, and bottom 25 and four sides 27-1 through 27-4 may be arranged to define collectively an open-topped container having a generally rectangular prismatic chamber 29. Handles 30, which may be retractable handles, may be provided on sides 27-1 and 27-3 of body 21 to facilitate the transport of active temperature-control system 13. (It is to be noted that handle 30 on side 27-1 is not shown herein.)

A storage basin 31, which may be used to receive passive temperature-control system 15 and which may comprise one or more thermally-insulating walls, may be disposed within chamber 29. A refrigeration unit 33, which may comprise a vapor compression-based cooling system and a circulatory fan (as well as a shroud for the fan), may also be disposed within chamber 29. Refrigeration unit 33 may also comprise a top wall 35 having one or more inlets 37 through which air to be cooled may be drawn by the circulatory fan into the cooling system of refrigeration unit 33 and may further include a side wall 39 having one or more outlets 41 through which air that has been cooled by the cooling system of refrigeration unit 33 may be expelled by the circulatory fan into storage basin 31.

Although not shown, body 21 may be equipped with a light for use in illuminating chamber 29, particularly the interior of storage basin 31. If desired, such a light may be illuminated only when cover 23 is opened.

Cover 23, which may comprise a thermally-insulating material, may be dimensioned to cover the entirety of chamber 29 and may form a substantially airtight seal with body 21. Cover 23 may be hingedly mounted at one end on side 27-1 of body 21 and may be adapted to be reversibly lockably latched onto side 27-3 of body 21. When cover 23 is closed, thermal communication between the contents of storage basin 31 and the environment that is external to active temperature-control system 13 preferably is minimized.

Preferably, active temperature-control system 13 is configured so that refrigeration unit 33 keeps the contents of storage basin 31 within a preset temperature range, such as 2° C.-8° C. To this end, active temperature-control system 13 is preferably equipped with a temperature sensor for monitoring the temperature within active temperature-control system 13, and active temperature-control system 13 preferably is also equipped with a control unit for controlling the operation of refrigeration unit 33 based on the sensed temperature within active temperature-control system 13. Active temperature-control system 13 may further comprise a control panel 51 for use in interfacing with said control unit. In the present embodiment, control panel 51 may be integrated into side 27-3.

Figure 4:
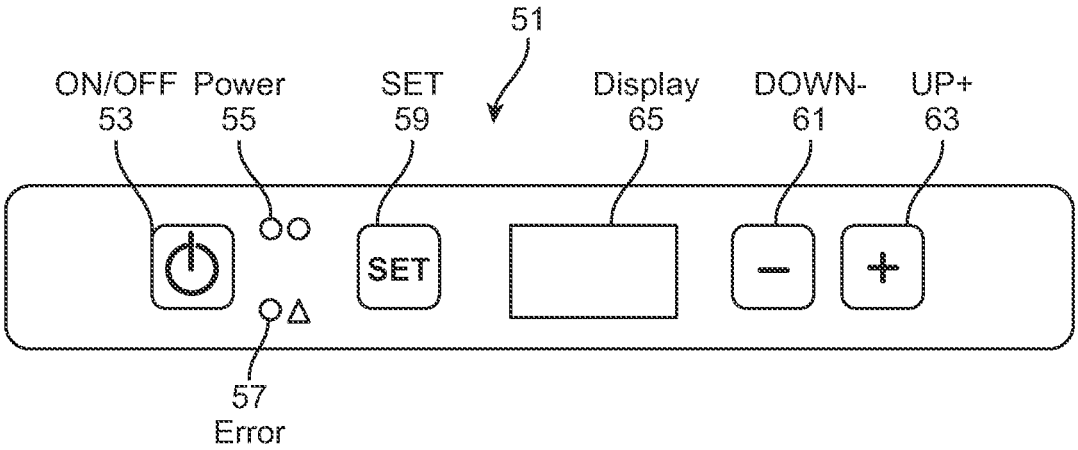
FIG. 4 is an enlarged front view of the control panel for the active temperature-control system shown in FIG. 1.

Referring now to FIG. 4, there is shown an enlarged front view of control panel 51. Control panel 51 may comprise an ON/OFF button 53, which may be used to turn on and off refrigeration unit 33. Control panel 51 may additionally comprise a power indicator 55, which may illuminate when the power is on, and an error indicator 57, which may illuminate in the event of a malfunction. Control panel 51 may further comprise a SET button 59, a down button 61, and an up button 63, all of which may be used for password-protected adjustments to the preset temperature range. Finally, control panel 51 may further comprise a display 65, which may indicate "HI" if the sensed temperature within the unit is above the upper limit of the temperature range (e.g., above 8° C.), "SAFE" if the sensed temperature within the unit falls within the temperature range (e.g., within 2° C. to 8° C.), or "LO" if the sensed temperature within the unit is below the lower limit of the temperature range (e.g., below 2° C.). Alternatively, display 65 may display the actual sensed temperature within the unit.

Figure 5:
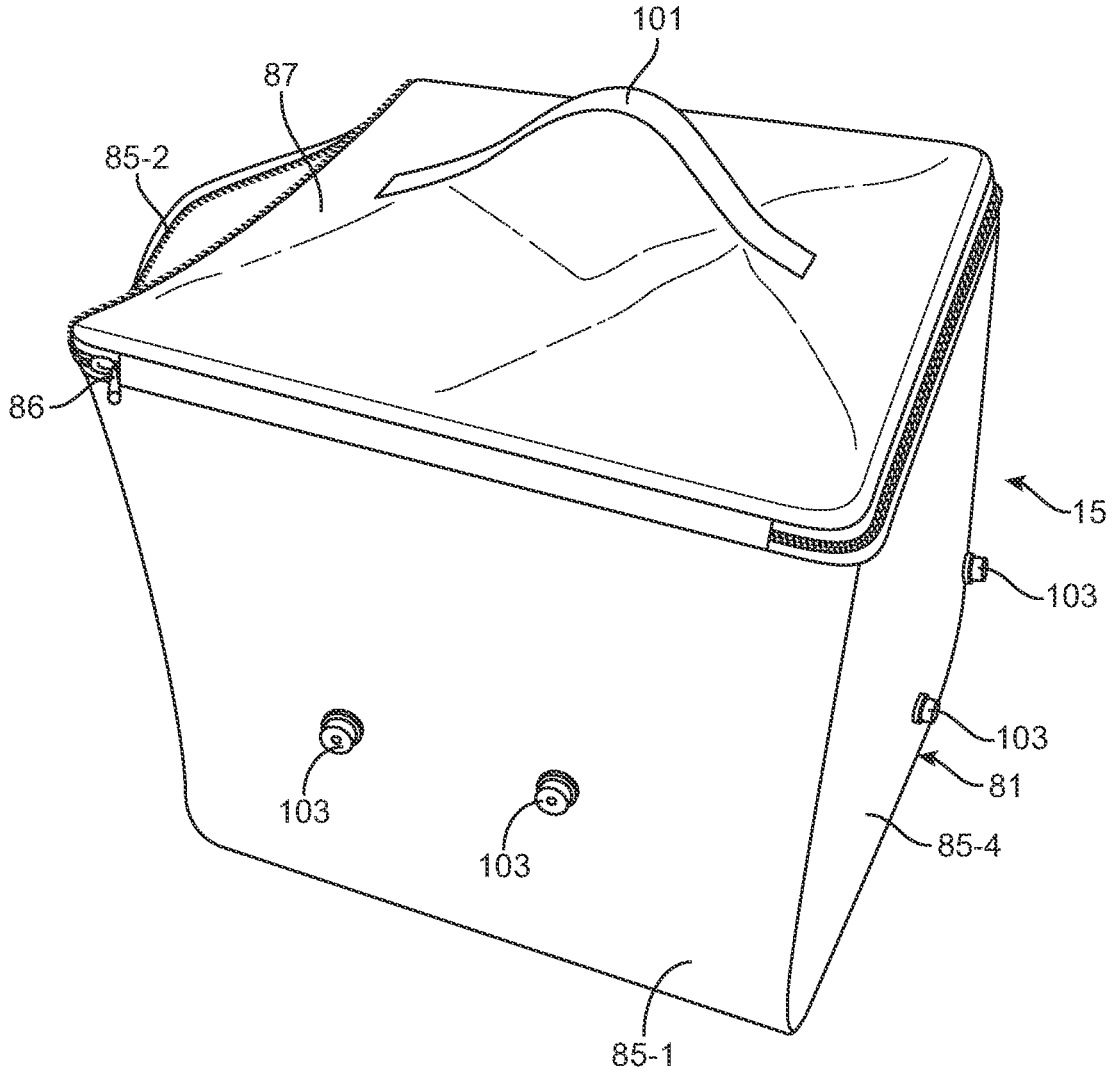
FIG. 5 is a perspective view of the passive temperature-control system shown in FIG. 2, the passive temperature-control system being shown in a closed state.
Figure 6A:
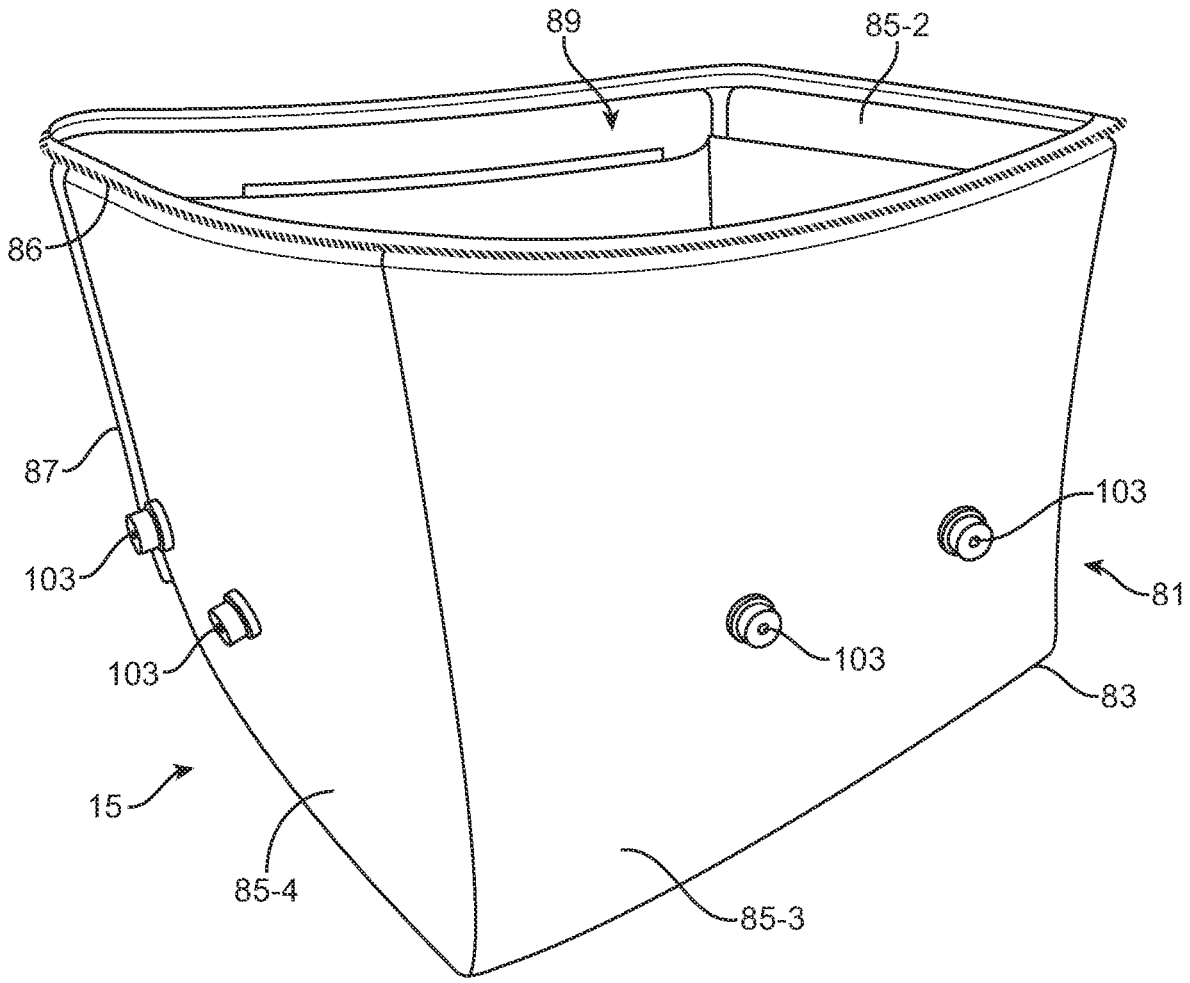
FIGS. 6(*a*) and 6(*b*) are perspective views of the passive temperature-control system shown in FIG. 5, the passive temperature-control system being shown in an open state.
Figure 6B:
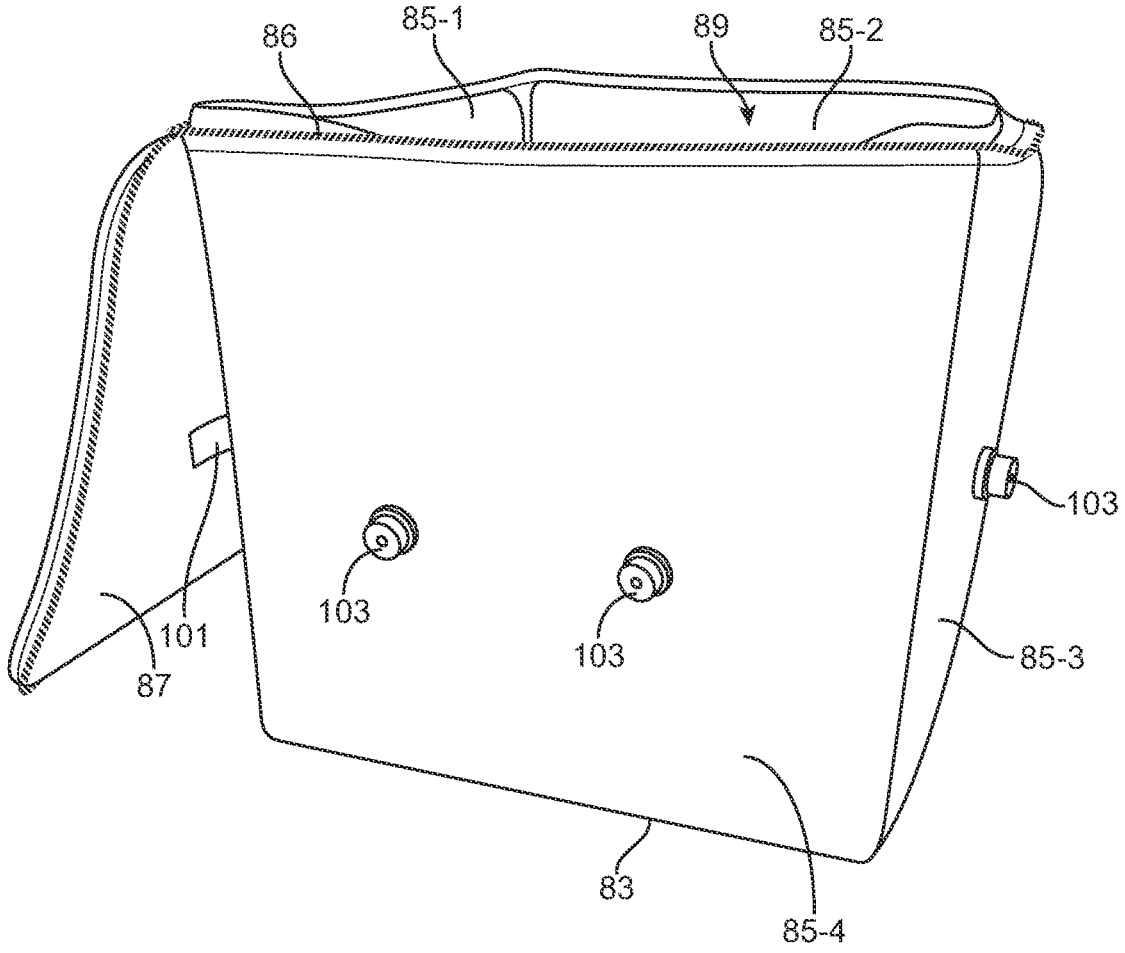
Figure 7:
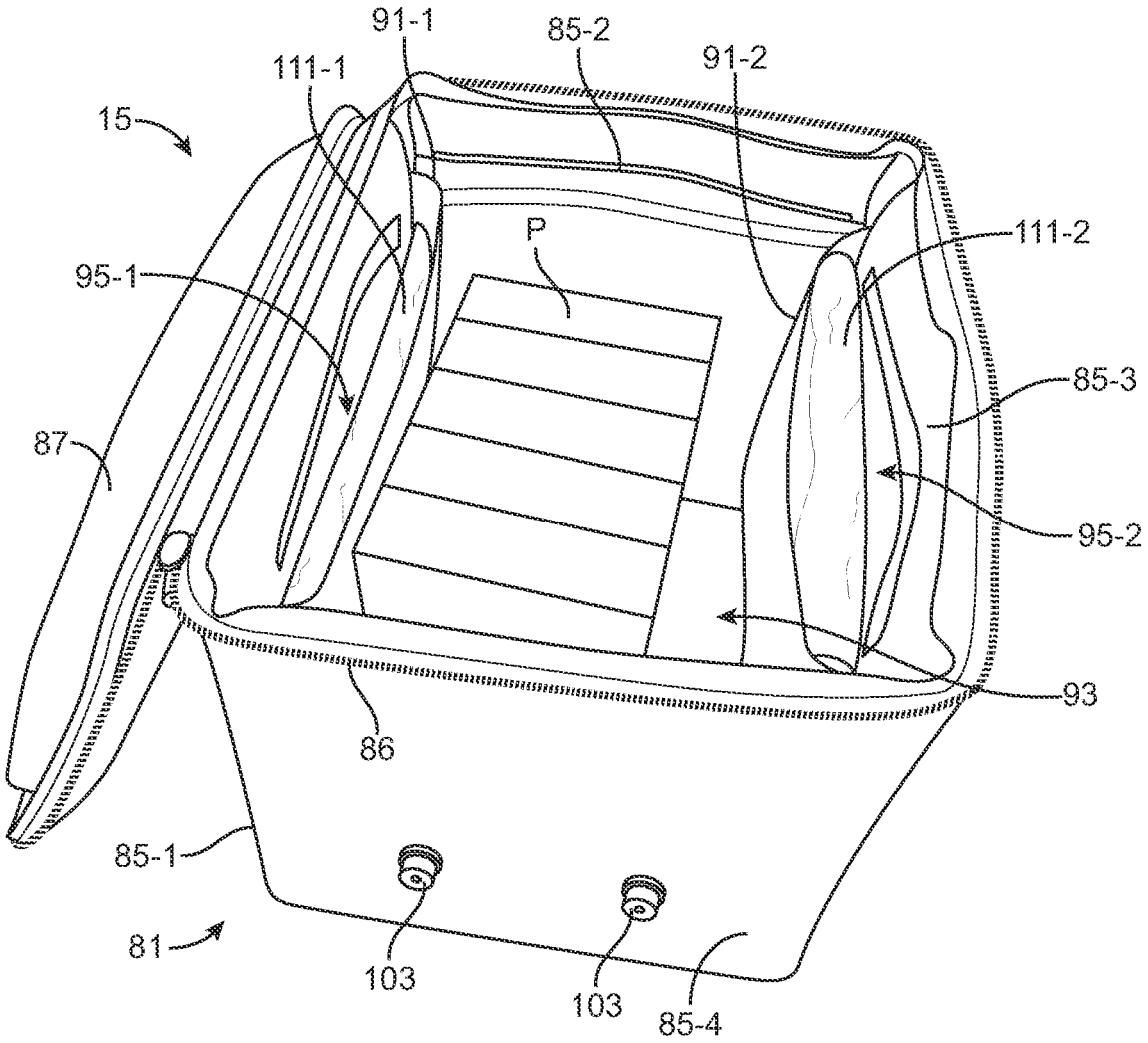
FIG. 7 is a perspective view of the passive temperature-control system shown in FIG. 5, the passive temperature-control system being shown in an open state with a payload disposed therewithin.

Referring now to FIGS. 5, 6(*a*), 6(*b*) and 7, there are shown various views of passive temperature-control system 15. Passive temperature-control system 15 may comprise a carry bag 81. Carry bag 81, which is preferably sized to fit within the unoccupied space of chamber 29, may comprise a bottom 83, four sides 85-1 through 85-4, and a top 87. Each of bottom 83, sides 85-1 through 85-4, and top 87 may comprise a flexible, thermally-insulating material, such as a polyethylene foam material, encased within a flexible material. The flexible material may be, for example, one or more flexible fabric sheets, which may comprise polyester of NYLON polyamide. A stiffening insert (not shown) may be included within one or more of bottom 83, sides 85-1 through 85-4 and top 87 to provide some structural support thereto. If desired, one or more of bottom 83, sides 85-1 through 85-4, and top 87 may be constructed so that their interior faces have a sham pocket, in which the thermally-insulating material and/or stiffening insert may be removably positioned. Hook and loop fasteners may be used to close the sham pockets.

Bottom 83 may be fixedly joined to each of sides 85-1 through 85-4, and each of sides 85-1 through 85-4 may be fixedly joined to its two adjacent sides. Top 87 may be fixedly joined to side 85-1 and may be reversibly joined to each of sides 85-2 through 85-4 with a zipper 86. In this manner, bottom 83, sides 85-1 through 85-4, and top 87 may collectively define a generally rectangular prismatic cavity 89. Cavity 89 may be divided by one or more dividers into a payload receiving space and one or more PCM member receiving spaces. In the present embodiment, there are shown two dividers 91-1 and 91-2, generally parallel to sides 85-1 and 85-3, respectively, dividing cavity 89 into a payload receiving space 93 and two PCM member receiving spaces 95-1 and 95-2, with PCM member receiving spaces 95-1 and 95-2 being positioned on opposite sides of a centrally-located payload receiving space 93; however, it is to be understood that the number of dividers and PCM member receiving spaces shown herein is merely illustrative. Accordingly, there may be fewer dividers and fewer PCM member receiving spaces than those shown, or there may be as many as six or more dividers and PCM member receiving spaces (e.g., at least one divider and PCM member receiving space along each face of the payload receiving space).

Carry bag 81 may further comprise a handle 101, which may be fixedly secured to the exterior of top 87. Handle 101, which may be in the form of a strip of webbing secured at opposite ends to top 87, may be used to facilitate the carrying, by hand, of passive temperature-control system 15. In addition, carry bag 81 may further comprise one or more standoffs 103, which may be fixedly secured to the exterior of bottom 83 and sides 85-1 through 85-4. Standoffs 103 may serve to space bottom 83 and sides 85-1 through 85-4 from adjacent surfaces of storage basin 31 and refrigeration unit 33 to promote the circulation of air around the exterior of carry bag 81 when carry bag 81 is disposed within body 21 and cover 23 is closed. In this manner, variations in temperature to which carry bag 81 is exposed may be minimized. In the present embodiment, standoffs 103 may be dimensioned to extend approximately ½ inch (±⅛ inch) from bottom 83 and sides 85-1 through 85-4, and standoffs 103 may have a rounded profile with a diameter of approximately ¾ inch; however, variations in the shape and dimensions of standoffs 103 are contemplated to be within the scope of the present invention. In the present embodiment, two standoffs 103 are provided on each of bottom 83 and sides 85-1 through 85-4; however, variations in the number of standoffs 103 are contemplated to be within the scope of the present invention. For example, in another embodiment (not shown), four or five standoffs may be positioned on each of bottom 83 and sides 85-1 through 85-4. More specifically, four standoffs may be positioned on each of bottom 83 and sides 85-1 through 85-4 approximately 1 inch from the edges of each surface, and an additional standoff may be positioned at the center of each surface of bottom 83 and sides 85-2 through 85-4. (A fifth standoff may be omitted from side 85-1 to accommodate printed matter, such as a logo.)

Without wishing to be limited to any particular dimensions, carry bag 81 may be sized to have an outer length of approximately 11 inches, an outer width of approximately 11 inches, and an outer height of approximately 11 inches. In addition, each of bottom 83, sides 85-1 through 85-4, and top 87 may include foam insulating material having a thickness of approximately ¾ inch.

Passive temperature-control system 15 may further comprise two PCM members 111-1 and 111-2. PCM member 111-1 may be removably disposed in PCM member receiving space 95-1, and PCM member 111-2 may be removably disposed in PCM member receiving space 95-2. (Alternatively, in another embodiment (not shown), PCM members 111-1 and 111-2 may be permanently disposed within carry bag 81.) PCM members 111-1 and 111-2, which may be conventional, may take a variety of physical forms including, but not limited to, a freezable brick, a freezable bag, a freezable mat, or a freezable bottle, and may comprise a variety of phase-change materials including, but not limited to, water-based phase-change materials and organic-based phase-change materials. Preferably, PCM members 111-1 and 111-2 have a phase-change temperature that falls within the temperature range at which active temperature-control system 13 operates. Examples of materials that may be suitable for use as PCM members 111-1 and 111-2 include, but are not limited to, materials disclosed in U.S. Pat. No. 9,556,373, inventors Formato et al., issued Jan. 31, 2017, and U.S. Pat. No. 9,598,622, inventors Formato et al., issued Mar. 21, 2017, both of which are incorporated herein by reference.

It is to be understood that, although two PCM members 111-1 and 111-2 are shown in the present embodiment, the number of PCM members in the present embodiment is merely illustrative. Accordingly, there may be as few as one PCM member or there may be three or more PCM members. For example, there could be six PCM members if one wishes to position a PCM member on each side of a rectangularly-shaped payload. Moreover, it is also to be understood that, although the present embodiment shows cavity 89 divided into a payload receiving space 93, in which the payload is received, and two PCM member receiving spaces 95-1 and 95-2, in which PCM members 111-1 and 111-2 are disposed, cavity 89 need not be divided, and PCM members 111-1 and 111-2 may be positioned with the payload in the payload receiving space.

In use, preferably with cover 23 in a closed position, active temperature-control system 13 may be turned on, for example, by plugging active temperature-control system 13 into a suitable AC or DC power source, such as the electrical system of an automobile or other vehicle, and by pressing ON/OFF button 53. Display 65 may then display "SAFE" when the desired temperature range has been attained. Then, passive temperature-control system 15, which preferably has been preconditioned and has been loaded with payload P in payload receiving space 93, may be loaded into active temperature-control system 13. Active temperature-control system 13 then may maintain passive temperature-control product 15, as well as its contents, within the desired temperature range. When a delivery is to be made, passive temperature-control system 15 may be removed from active temperature-control system 13 and may be transported, preferably in a closed state, to a desired destination. Because passive temperature-control system 15 is equipped with PCM members 111-1 and 111-2, which have been maintained within the desired temperature range by active temperature-control system 13 up until the time passive temperature-control system 15 is removed from active temperature-control system 13, PCM members 111-1 and 111-2 are fully "charged" at the time that passive temperature-control system 15 is removed from active temperature-control system 13, thereby maximizing the duration at which passive temperature-control system 15 can operate. After the delivery has been made, passive temperature-control system 15 may be returned to active temperature-control system 13, whereby passive temperature-control system 15, and its contents including PCM members 111-1 and 111-2, may be placed again under the control of active temperature-control system 13. In this manner, PCM members 111-1 and 111-2 may be "recharged" for a second delivery, and the process may be repeated.

Preferably, carry bag 81 can accommodate enough pharmaceutical samples to enable a user to make 8-10 physician visits. Moreover, passive temperature-control system 15 is preferably constructed so that it may provide 2-3 hours or longer of protection after having been removed from active temperature-control system 13.

Figure 8:
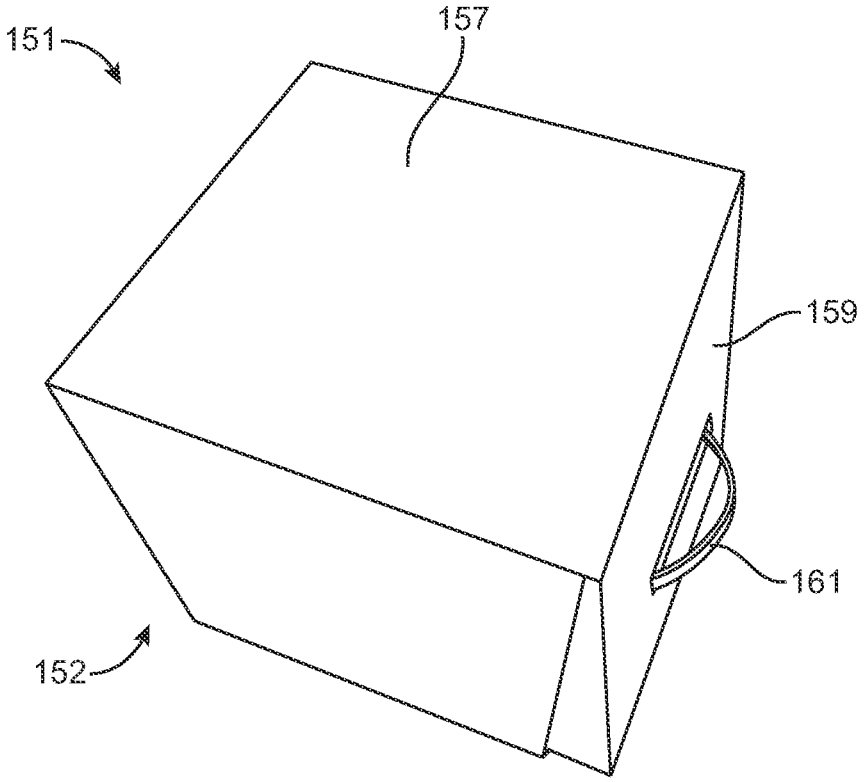
FIG. 8 is a perspective view of an alternative embodiment of a passive temperature-control system constructed according to the present invention, the passive temperature-control system being shown with its insulated container in a closed state.
Figure 9:
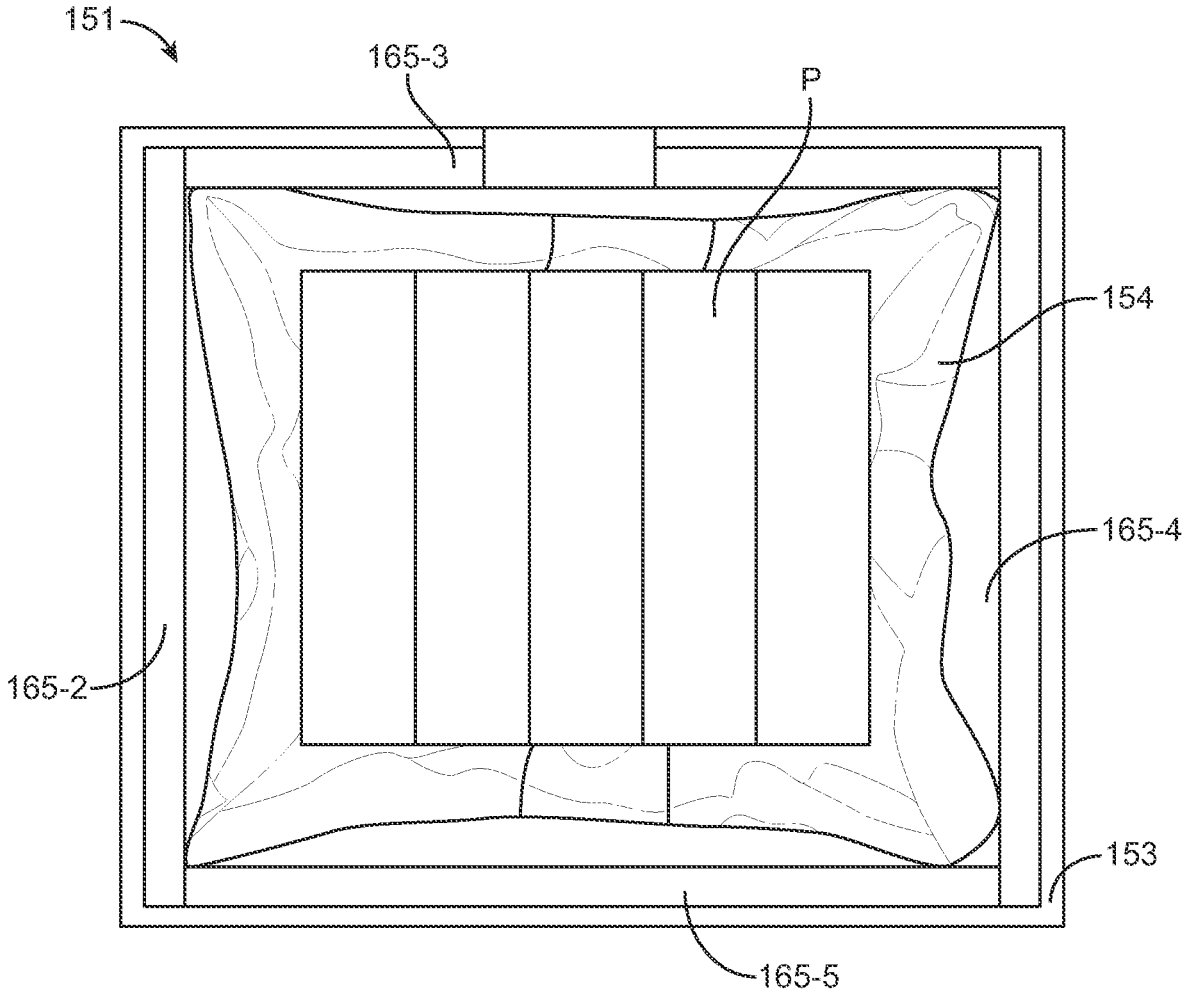
FIG. 9 is an enlarged fragmentary top view of the passive temperature-control system of FIG. 8, the passive temperature-control system being shown with its insulated container in an open state.

Referring now to FIGS. 8 and 9, there are shown different views of an alternative embodiment of a passive temperature-control system constructed according to the present invention, the passive temperature-control system being represented generally by reference numeral 151.

Figure 10:
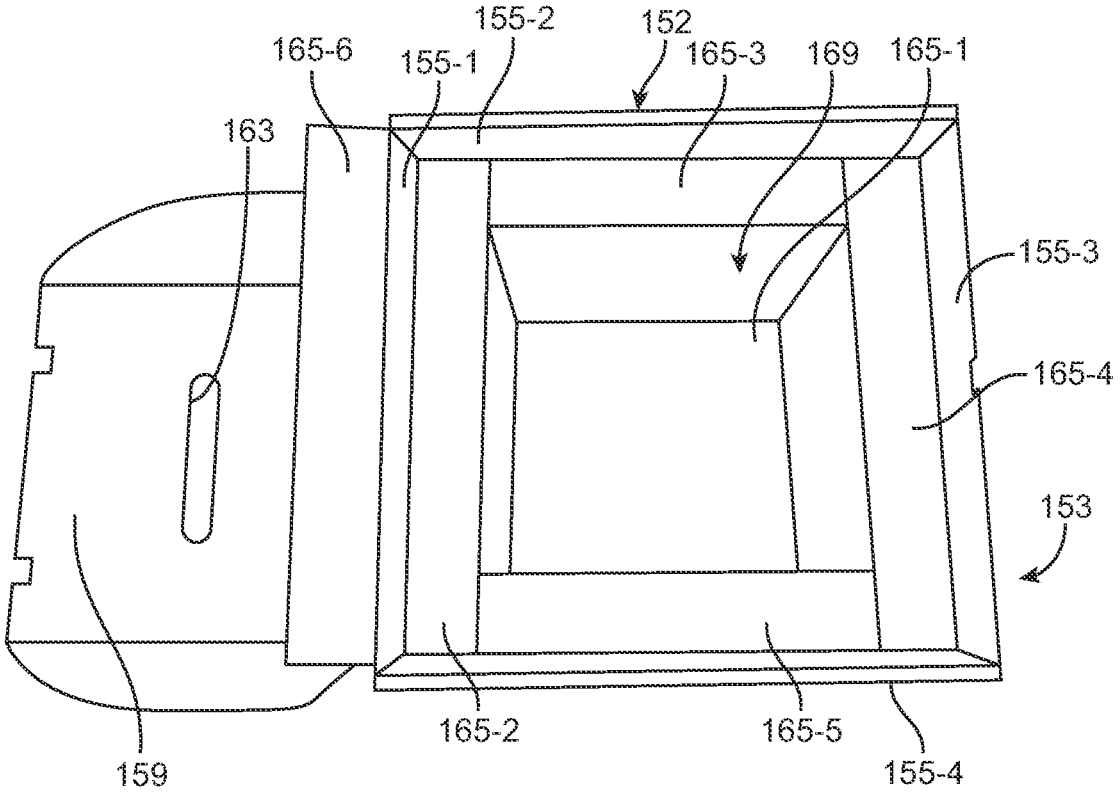
FIG. 10 is a perspective view of the container shown in FIG. 8, the insulated container being shown in an open state.

Passive temperature-control system 151 may comprise an insulated container 152. Insulated container 152, which is also shown separately in FIG. 10, may comprise a box 153. Box 153 may be made of corrugated cardboard, chipboard or a similar material and may be shaped to include a bottom, four sides 155-1 through 155-4, a top 157, and a closure assembly 159. A handle 161 may be mounted on side 155-3, and closure assembly 159 may be provided with a slot 163 through which handle 161 may be inserted. Box 153 may be secured shut using tape or other suitable means. Without wishing to be limited to any particular dimensions, box 153 may have an inner length of approximately 11.75 inches, an inner width of approximately 11.75 inches, and an inner height of approximately 11.75 inches. Although not shown, standoffs may be secured to one or more exterior surfaces of box 153.

Insulated container 152 may additionally comprise thermal insulation. In the present embodiment, said thermal insulation may be in the form of a plurality of foam blocks 165-1 through 165-6, which may be secured by adhesive or other suitable means to the interior surfaces of bottom, sides 155-1 through 155-4, and top 157 of box 153. Solely by way of example, foam blocks 165-1 through 165-6 may be flexible polyurethane foam having a thickness of approximately 1 inch. Box 153 and foam blocks 165-1 through 165-6 may collectively define a cavity 169.

Passive temperature-control system 151 may further comprise one or more PCM members 154. PCM members 154, which may be similar to PCM members 111-1 and 111-2, may be arranged in cavity 169 to form a central space in which a payload P of temperature-sensitive materials may be positioned. In the present embodiment, PCM members 154 may include 7° C. PCM in 2×7" mat pouches.

The embodiments of the present invention described above are intended to be merely exemplary and those skilled in the art shall be able to make numerous variations and modifications to it without departing from the spirit of the present invention. For example, although the present invention has been discussed in the context of a parcel-sized payload, the present invention is not limited to use with a parcel-sized payload and could be used, for example, with a pallet-sized payload or larger. For example, the active temperature-control system could be a refrigerated airline or freight container, and the passive temperature-control system could be a pallet shipper or pallet cover comprising PCM members, such as described in U.S. Pat. No. 9,180,998, inventors Banks et al., issued Nov. 10, 2015, U.S. Patent Application Publication No. US 2017/0096283 A1, inventors Longley et al., published Apr. 6, 2017, and U.S. Ser. No. 15/595,671, filed May 15, 2017, all of which are incorporated herein by reference. All such variations and modifications are intended to be within the scope of the present invention.

What is claimed is:

1. A hybrid system for transporting and/or storing temperature-sensitive materials, the hybrid system comprising:

(a) an active temperature-control system, the active temperature-control system comprising (i) a container having an internal chamber, and (ii) a refrigeration unit disposed within the internal chamber for maintaining items within the internal chamber within a desired temperature range of 2° C. to 8° C., the refrigeration unit comprising a vapor compression-based cooling system, and (iii) wherein the active temperature-control system is configured to be powered by direct current supplied by a vehicle comprising an electrical system; and (b) a passive temperature-control system, the passive temperature-control system being removably positioned entirely within the internal chamber of the active temperature-control system, wherein the passive temperature-control system comprises (i) an insulated bag, wherein the insulated bag comprises a bottom, four sides, and a top, wherein each of the bottom, the four sides, and the top comprises a flexible, thermally-insulating foam material encased within one or more flexible fabric sheets, and wherein the bottom, the four sides, and the top define an interior space for receiving one or more temperature-sensitive materials, and (ii) at least one phase-change material (PCM) member, wherein each of the at least one PCM member comprises a closed PCM container, disposed within the interior space of the insulated bag, and a quantity of PCM disposed within the closed PCM container, wherein the PCM has a phase-change temperature and wherein the phase-change temperature of the PCM is within the desired temperature range of 2° C. to 8° C. of the active temperature-control system.

2. The hybrid system as claimed in claim 1 wherein the active temperature-control system comprises a portable refrigerator.

3. The hybrid system as claimed in claim 2 wherein the portable refrigerator has a weight of approximately 10 kg to 35 kg and has outer dimensions not exceeding 1 cubic meter.

4. The hybrid system as claimed in claim 3 wherein the portable refrigerator has outer dimensions ranging from approximately 350 mm×425 mm×625 mm to approximately 950 mm×475 mm×530 mm.

5. The hybrid system as claimed in claim 2 wherein the portable refrigerator comprises a body and a cover, the body and the cover jointly defining the internal chamber of the container.

6. The hybrid system as claimed in claim 2 wherein the portable refrigerator comprises a control panel, the control panel including a display for indicating if the internal chamber is within a desired temperature range.

7. The hybrid system as claimed in claim 1 wherein the insulated bag is an insulated carry bag.

8. The hybrid system as claimed in claim 7 wherein the insulated carry bag further comprises at least one divider disposed within the interior space, the at least one divider dividing the interior space into a payload receiving space and at least one PCM member receiving space and wherein the at least one PCM member is disposed in the at least one PCM member receiving space.

9. The hybrid system as claimed in claim 8 wherein the insulated carry bag further comprises a handle, the handle comprising a strip secured opposite ends to the top of the insulated bag.

10. The hybrid system as claimed in claim 7 wherein the insulated carry bag has outer dimensions of 11 inches×11 inches×11 inches.

11. The hybrid system as claimed in claim 1 wherein the insulated carry bag further comprises at least one standoff positioned on an exterior of each of the bottom and the four sides.

12. The hybrid system as claimed in claim 1 wherein the PCM is an organic PCM.

13. The hybrid system as claimed in claim 1 wherein the active temperature-control system further comprises a retractable handle provided on the container.

14. A hybrid system for transporting and/or storing temperature-sensitive materials, the hybrid system comprising:

(a) an active temperature-control system, the active temperature-control system comprising an internal chamber and a refrigeration unit for maintaining contents within the internal chamber within a desired temperature range of 2° C. to 8° C., the refrigeration unit comprising a vapor compression-based cooling system, wherein the active temperature-control system is configured to be powered by direct current supplied by a vehicle comprising an electrical system; and (b) a passive temperature-control system, the passive temperature-control system being removably positioned entirely within the internal chamber of the active temperature-control system, the passive temperature-control system comprising (i) an insulated container, the insulated container comprising an interior, the interior including space for receiving one or more temperature-sensitive materials, (ii) a first phase-change material (PCM) member disposed within the interior of the insulated container, the first PCM member comprising a closed PCM container and a quantity of PCM disposed within the closed PCM container, wherein the PCM has a phase-change temperature and wherein the phase-change temperature of the PCM is within the desired temperature range of 2° C. to 8° C. of the active temperature-control system, the first PCM member being conditioned by the active temperature-control system while the passive temperature-control system is disposed within the active temperature-control system, and (iii) a handle secured to the insulated container for use in transporting the insulated container.

15. The hybrid system as claimed in claim 14 wherein the handle comprises a strip secured at opposite ends to a top of the insulated container.

16. The hybrid system as claimed in claim 14 wherein the insulated container is an insulated bag, the insulated bag comprising a bottom, four sides, and a top, wherein each of the bottom, the four sides, and the top comprises a flexible, thermally-insulating foam material encased within one or more flexible fabric sheets.

17. The hybrid system as claimed in claim 16 wherein the insulated bag further comprises at least one divider for dividing the interior of the insulated container into one or more PCM member receiving spaces and the space for receiving one or more temperature-sensitive materials.

18. The hybrid system as claimed in claim 16 wherein the insulated bag is an insulated carry bag.

19. The hybrid system as claimed in claim 14 wherein the active temperature-control system and the passive temperature-control system are dimensioned relative to one another so that exactly one passive temperature-control system is removably positioned within the internal chamber of the active temperature-control system.

20. The hybrid system as claimed in claim 14 wherein the passive temperature-control system further comprises a standoff secured to a bottom of the insulated container.

21. The hybrid system as claimed in claim 14 wherein the passive temperature-control system further comprises at least one standoff secured to a bottom of the insulated container and at least one standoff secured to a side of the insulated container.

* * * * *